United States Patent [19]

Nakazawa et al.

[11] 4,435,973

[45] Mar. 13, 1984

[54] METHOD OF PRODUCING RING-SHAPED METAL PARTS

[75] Inventors: Shigeo Nakazawa, Yokohama; Shintaro Sato, Fujisawa, both of Japan

[73] Assignee: Nissan Motor Co., Ltd., Yokohama, Japan

[21] Appl. No.: 325,052

[22] Filed: Nov. 25, 1981

[51] Int. Cl.[3] ..... B21D 28/00; B21D 28/14; B21D 28/24

[52] U.S. Cl. ..... 72/327; 72/354; 72/359; 72/330

[58] Field of Search ..... 72/325–330, 72/352–354, 358–360; 29/159.2

[56] References Cited

U.S. PATENT DOCUMENTS

| | | | |
|---|---|---|---|
| 1,314,036 | 8/1919 | Amberg . | |
| 1,410,093 | 3/1922 | Dallmeyer et al. | 72/359 |
| 2,586,336 | 2/1952 | Huck | 72/354 |
| 2,627,652 | 2/1953 | Schweller | 72/359 |
| 3,247,534 | 4/1966 | McClellan | 72/359 |
| 4,008,599 | 2/1977 | Dohmann | 29/159.2 |
| 4,299,112 | 11/1981 | Kondo et al. | 29/159.2 |

FOREIGN PATENT DOCUMENTS

| | | | |
|---|---|---|---|
| 1752981 | 7/1971 | Fed. Rep. of Germany . | |
| 661584 | 7/1929 | France . | |
| 1011116 | 6/1952 | France | 72/327 |
| 107912 | 12/1924 | Switzerland | 72/352 |

*Primary Examiner*—Daniel C. Crane

*Attorney, Agent, or Firm*—Lane, Aitken & Kananen

[57] ABSTRACT

A method of producing a plurality of identical ring-shaped metal parts from a single blank in the form of solid rod without forming any hole in the blank and without cross-sectionally cutting the blank. The outer periphery of the blank corresponds to the inner periphery of the metal parts to be produced. First the blank is longitudinally compressed such that an end portion of the blank undergoes upsetting and provides a laterally expanded portion having a side periphery corresponding to the outer periphery of the metal parts and a length corresonding to the thickness of the metal parts. Then the laterally expanded portion is subjected to shearing along a plane defining the outer periphery of the blank to part its peripheral region as one of the ring-shaped metal parts. The blank remains in the solid rod form, though somewhat shortened, and therefore can be used to produce additional metal parts by repeating the same procedure until it becomes very short. The upsetting step and the shearing step can be performed in the same machine by using a set of opposingly arranged dies and coaxially arranged punches. Ring-like metal parts noncircular in their outer and inner peripheries can also be produced by the same method.

8 Claims, 51 Drawing Figures

METHOD OF PRODUCING RING-SHAPED METAL PARTS

BACKGROUND OF THE INVENTION

This invention relates to a method of producing a plurality of identical ring-shaped metal parts from a rod-shaped blank by repetition of a sequential combination of upsetting working and shearing working.

Die forging has been employed to produce ring-shaped metal parts of relatively high strength and high precision, such as intermediates of gears for instance.

In a conventional ring producing method of this type, a disk-shaped blank is first formed into an intermediate having the shape of a shallow dish by die forging, using a stationary die formed with a circular recess having a diameter corresponding to the outer diameter of the ring-shaped metal part to be produced and a movable die formed with a short cylindrical projection having a diameter corresponding to the inner diameter of the ring-shaped part. That is, the blank is axially compressed between the two dies and, hence, is forced to radially expand into an annular space given by partial intrusion of the projection of the movable die into the recess of the stationary die. The intermediate has an annular brim portion greater in thickness than the circular bottom portion.

This intermediate is transferred into another press which is equipped with a shearing die having a central hole having a diameter which corresponds to the inner diameter of the intermediate, and the circular bottom portion of the intermediate is punched out by the action of a shearing punch fittable into the hole of the shearing die to leave the annular brim portion of the intermediate as the intended ring-shaped metal part. The separated bottom portion of the intermediate is disposed of as scrap.

From a commercial point of view, it is a disadvantage of this ring producing method that a considerable portion of the material must be scrapped with extra labor costs for recovery and handling of the scrap portions of the individual intermediates. Besides, there is the need for transferring the intermediates from the forging machine to the shearing machine. Furthermore, there is a possibility of suffering from an insufficiency in the precision of the ring-shaped parts by reason of some errors in the alignment of the individual intermediates with the shearing die.

SUMMARY OF THE INVENTION

It is an object of the present invention to provide a novel method of producing a plurality of identical ring-shaped or ring-like metal parts, which method obviates the above described disadvantages of the conventional method and makes it possible to successively and efficiently produce ring-shaped metal parts of high quality at a greatly reduced material cost.

A method according to the invention for the production of a plurality of identical ring-shaped or ring-like metal parts comprises the following steps: (a) applying a compression force to a blank of a metal material, which is in the shape of a solid rod having an outer periphery corresponding to the inner periphery of the metal parts to be produced, in a longitudinal direction of the blank so as to upset an end portion of the blank until this end portion transforms into a laterally expanded portion having a side periphery corresponding to the outer periphery of the aforementioned metal parts and a length corresponding to the thickness of the metal parts, (b) subjecting the laterally expanded portion of the blank to shearing along a plane defining the outer periphery of the initial blank thereby parting this laterally expanded portion into a peripheral portion, which is one of the metal parts to be produced, and a central portion which remains as an end portion of the blank shortened by the step (a), and (c) repeating the steps (a) and (b) by using the shortened blank remaining after the step (b) in place of the blank in the initially performed step (a).

By this method, it is possible to produce not only ring-shaped metal parts which are circular in their outer and inner peripheries but also ring-like metal parts which have a central hole but noncircular in their outer and/or inner peripheries. For example, the outer and/or inner peripheries of such noncircular ring-like parts may be octagonal or elliptical.

The above stated method of the invention is quite unique primarily in that an elongate rod-shaped blank is employed to produce a plurality of identical ring-shaped or ring-like parts (hereafter, "or ring-like" will be omitted for brevity) without forming any hole in the blank and without cutting the blank cross-sectionally at any stage of production. At the first step, an end portion of the rod-shaped blank is subjected to upsetting with the result that the blank transforms into an intermediate which consists of a stem portion or the unworked portion of the blank and a head portion having a disk-like shape with a side periphery corresponding to the outer periphery of the ring-shaped parts to be produced and a length or thickness corresponding to the thickness of the ring-shaped parts. Naturally the total length of this intermediate is shorter than the initial length of the blank. At the next step, this intermediate is subjected to a shearing operation to separate only a peripheral portion of the head portion from the remaining portion along a shearing plane that defines the outer periphery of the initial blank and, hence, the inner periphery of the ring-shaped parts. Therefore, the separated portion has the shape and dimensions of the desired ring-shaped parts.

As will be understood, no portion of the initial blank is last or wasted throughout the upsetting and shearing steps. At the end of the shearing step, the remaining portion of the intermediate has the shape of a rod which is shorter than the blank in the initial state but has the same outer periphery as the blank in the initial state. Accordingly this rod can be used to produce another ring-shaped part through the same upsetting and shearing steps, and the same process can be repeated until the intermediate at the end of the shearing step becomes too short to produce another ring-shaped part.

In this method, therefore, only a very small portion of the blank is scrapped when the initial length of the blank is sufficiently large compared with the volume of each ring-shaped part.

The upsetting step and the shearing step may be performed by using two separate apparatuses, respectively, but it is possible and advantageous to consecutively perform these two steps in the same apparatus. In the latter case, use will be made of a forging machine or a press having two opposingly arranged dies each of which is formed with a guide hole identical in cross section with the rod-shaped blank and two punches slidably fitted in the two holes, respectively. Upsetting of an end portion of the blank is performed while holding the remaining portion of the blank in the guide hole of one of these dies, and shearing of the aforementioned intermediate is achieved by applying an axially thrusting force to the intermediate via one of the punches while the peripheral portion of the head portion of the intermediate is held between the die faces, as will be illustrated hereinafter. By consecutively performing the upsetting and shearing steps in this manner, it is possible to greatly enhance the productivity and, moreover, the ring-shaped parts are obtained with improved precision because there is no possibility of alignment errors between the upsetting operation and the shearing operation.

At the initial step, upsetting of the end portion of the blank may be performed either in the manner of free upsetting between two opposing die faces or in the manner of restricted upsetting or a sort of closed die forging as will be illustrated hereinafter.

A method according to the invention is quite suitable to the production of ring-shaped parts of aluminum alloys and is of use also in the production of ring-shaped parts of some steels such as chromium steels. In many cases this method can be performed without the need of heating the blank, but sometimes preheating of the blank becomes necessary particularly in the cases of working steels.

DESCRIPTION OF THE PREFERRED EMBODIMENTS

Before describing embodiments of the present invention, reference is made to FIGS. 1(A) to 1(C) and FIGS. 2(A) to 2(C) which illustrate the aforementioned conventional method of producing a ring-shaped metal part.

Figure 1A:
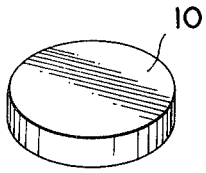
FIG.1(A) PRIOR ART
FIGS. 1(A), 1(B) and 1(C) illustrate the manner of transformation of a circular blank into a ring-shaped part in a conventional ring producing method.
Figure 2A:
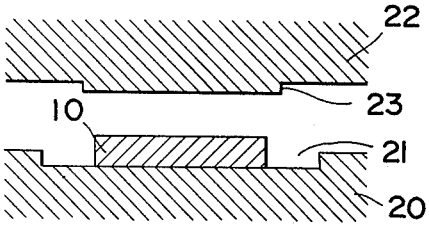
FIG.2(A) PRIOR ART
FIGS. 2(A) and 2(B) illustrate a forging step in the conventional ring producing method.
Figure 1B:
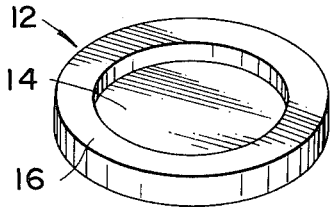
FIG.1(B) PRIOR ART
Figure 2B:
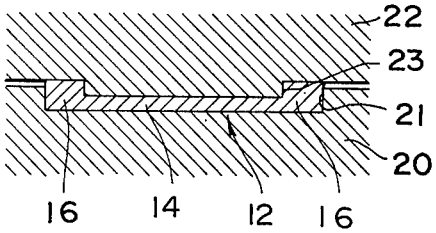
FIG.2(B) PRIOR ART

FIG. 1(A) shows a disk-shaped blank 10 for use in the conventional method. The diameter of the blank 10 is smaller than the outer diameter of the ring to be produced, but the thickness of the blank 10 is greater than that of the ring. FIG. 2(A) shows a set of forging dies 20 and 22 attached to a forging press (not shown) to perform the initial step of the ring producing method. The die face of the lower die 20 is formed with a circular recess 21 having a diameter corresponding to the outer diameter of the ring to be produced, and the die face of the upper die 22 is formed with a short cylindrical projection 23 having a diameter corresponding to the inner diameter of the ring. The disk-shaped blank 10 is placed in the center of the recess 21 in the lower die 20, and the upper die 22 is moved downwards to compress the blank 10 between the two dies 20 and 22, as shown in FIG. 2(B). The blank 10 is forced to reduce its thickness and expand radially, but the radial expansion is restricted by the cylindrical wall defining the periphery of the circular recess 21, so that the expanded portion of the blank material flows towards the upper die 22. The descent of the upper die 22 is continued until an annular space given by partial intrusion of the projection 23 of the upper die 22 into the recess 21 of the lower die 20 is filled with the radially expanded portion of the blank material. As the result, the blank 10 is formed into an intermediate 12 shown in FIG. 1(B), which has the shape of a shallow dish consisting of a flat and circular bottom portion 14 and an annular brim portion 16 greater in thickness than the bottom portion 14.

Figure 1C:
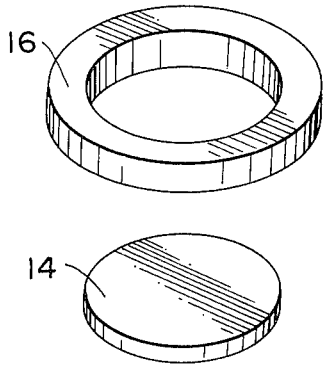
FIG.1(C) PRIOR ART
Figure 2C:
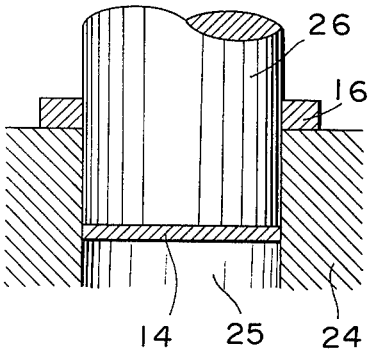
FIG.2(C) PRIOR ART
FIG. 2(C) illustrates a punching step in the same method.

Referring to FIG. 2(C), this intermediate 12 is transferred into another press (not shown) equipped with a shearing die 24 having a cylindrical hole 25 of which diameter is equal to the inner diameter of the intended ring and, hence, to the inner diameter of the intermediate 12. The intermediate 12 is placed on the shearing die 24 in axial alignment with the hole 25, and a shearing punch 26 is moved downward to punch out the central bottom portion 14 of the intermediate 12 with the result that the annular brim portion 16 of the intermediate 12 turns into a ring-shaped metal part as shown in FIG. 1(C). The separated bottom portion 14 of the intermediate 12 is to be scrapped.

By contrast with the above described and illustrated conventional method, the distinctive features of the present invention will readily be understood from the following description of the preferred embodiments.

As a first embodiment of the invention, FIGS. 3(A) to 3(J), 4(A) to 4(E) and 5 illustrate a method of producing a plurality of identical ring-shaped metal parts which are circular in their outer and inner peripheries. FIG. 4(A) shows a blank 30 in the form of a solid cylinder for use in this method. The diameter of this blank 30 corresponds to the inner diameter of the ring-shaped metal parts (hereinafter, will simply be called rings) to be produced. The length $L_0$ of the blank 30 is more than two times as large as the thickness of each ring and the volume of the blank 30 is more than two times as large as the volume of each ring.

Figure 3A:
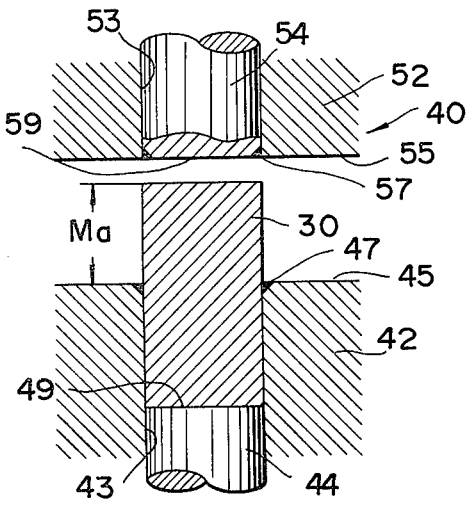
FIG. 3(A) is a fragmentary and partly longitudinal-sectional view of a set of dies and punches used in a ring producing method as an embodiment of the present invention.
Figure 4A:
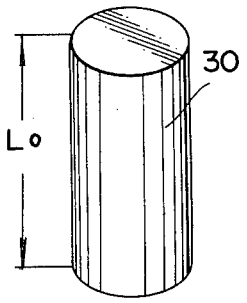
FIG. 4(A) is a perspective view of a cylindrical blank for use in the method illustrated by FIGS. 3(A) to 3(J), and FIGS. 4(B) to 4(E) illustrate the manner of sequential transformation of this blank in the same method.

FIG. 3(A) shows apparatus 40 for use in this method. Actually the apparatus 40 includes a conventional press that serves as a forging machine, but the press is omitted from illustration. The principal part of this apparatus 40 consists of a lower die 42 which is fixed to the base of the press and has a vertical and cylindrical through-hole 43, an uper die 52 which is attached to a main ram of the press and has a cylindrical through-hole 53 in axial alignment with the hole 43 in the lower die 42, a lower punch 44 slidably fitted in the hole 43 of the lower die 42 and supported by a lower sub-ram of the press, and an upper punch 54 slidably fitted in the hole 53 of the upper die 52 and supported by an upper sub-ram of the press. The two holes 43 and 53 have the same diameter that corresponds to the inner diameter of the rings to be produced. The upper end face 45 of the lower die 42 and the lower end face 55 of the upper die 52 are flat and parallel to each other, and the upper end 49 of the lower punch 44 and the lower end 59 of the upper punch 54 are flat and parallel to the die faces 45, 55. To perform not only an upsetting working but also a shearing working by this apparatus, a circular edge region 47 of the lower die 42 at the upper mouth of the hole 43 and a circular edge region 57 of the upper punch 54 at its lower end are hardened by heat treatment to become cutting edges. (These cutting edges 47, 57 are omitted from illustration in the subsequent figures.)

Initially, the upper die 53 is sufficiently spaced from the lower die 42 with the upper punch 54 positioned such that the lower end face 59 of this punch 54 is flush with the lower end face 55 of the upper die 52. The lower punch 44 is kept at a sufficiently low position, and the cylindrical blank 30 of FIG. 4(A) is fitted into the hole 43 of the lower die 42 so as to rest on the upper end face 49 of the lower punch 44 and partly protrude from the hole 43 toward the upper die 52. The length $M_a$ of the protruded portion of the blank 30 in FIG. 3(A) is greater than the thickness of a ring to be produced and is suitably predetermined according to the dimensions of the ring.

Figure 5:
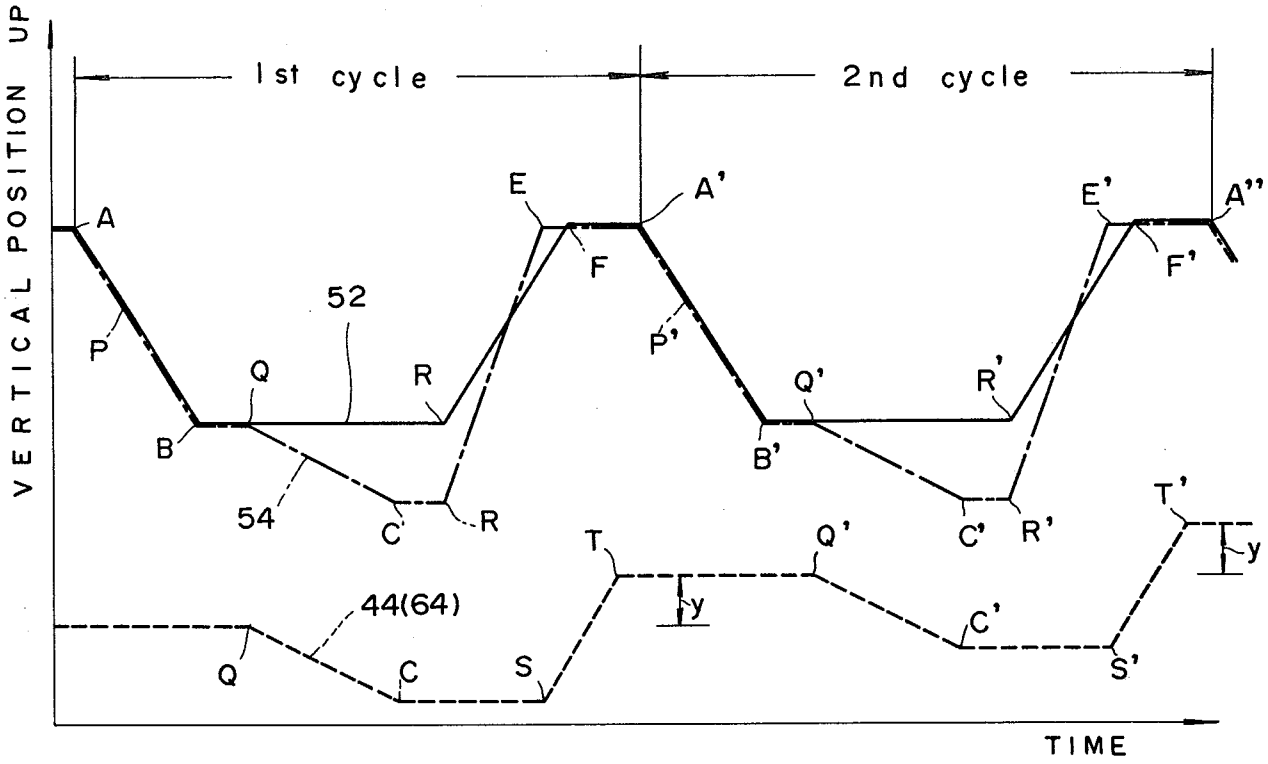
FIG. 5 is a diagram showing the sequence and extent of the movements of the punches and upper die of FIG. 3(A) in the method illustrated by FIGS. 3(A) to 3(J)

FIG. 5 is a diagram showing changes in the vertical positions of the lower end face 55 of the upper die 52 (represented by solid line), the lower end 59 of the upper punch 54 (represented by chain line) and the upper end 49 of the lower punch 44 (represented by broken line) during operation of the apparatus 40 to perform the ring producing method. The point A in FIG. 5 corresponds to the initial state shown in FIG. 3(A).

Figure 3B:
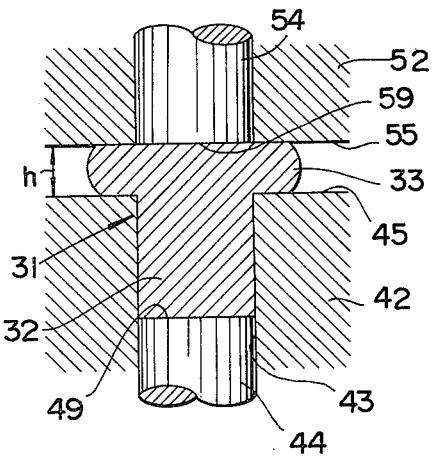
FIGS. 3(B) to 3(J) show the same set of dies and punches at different stages of the same method.

In an upsetting operation as the first step of this ring producing method, the upper die 52 is moved downwards together with the upper punch 54 so that the lower end 59 of the upper punch 54 serves as part of the upper die face 55. At point P in FIG. 5 the upper punch 54 comes into contact with the blank 30, and as the upper die 52 and the punch 54 continue to descend the protruded portion of the blank 30 undergoes free upsetting. That is, this portion of the blank 30 is axially compressed and forced to radially expand. The descent of the upper die 52 and punch 54 is terminated at point B in FIG. 5 where the distance between the upper and lower dies 52 and 42 reaches a predetermined value h as shown in FIG. 3(B). During the free upsetting process from the point P to the point B the blank 30 is transformed into an intermediate 31 shown in FIGS. 3(B) and 4(B). This intermediate 31 consists of a cylindrical stem portion 32, i.e. the lower portion of the cylindrical blank 30 held in the hole 43 of the lower die 42, and a disk-shaped head portion 33 considerably larger in diameter than the stem portion 32. The thickness of the head portion 32 is equal to the aforementioned distance h between the two dies 42 and 52, and the diameter of the head portion 32 is determined by the extent of compression or the difference of the thickness h from the initial length $M_a$ of the protruded portion of the blank 30 in FIG. 3(A).

Figure 4B:
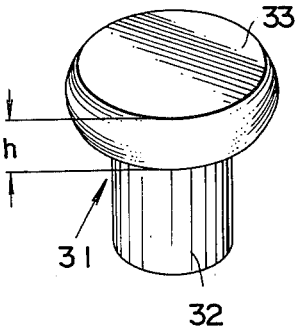
Figure 3C:
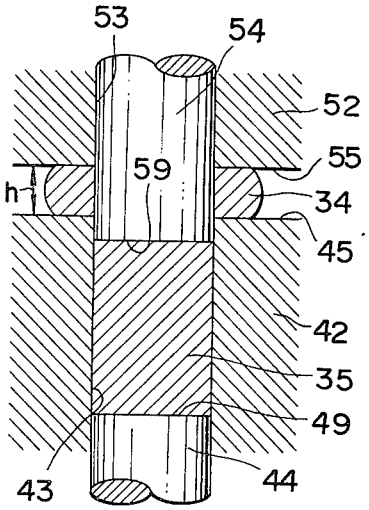
Figure 4C:
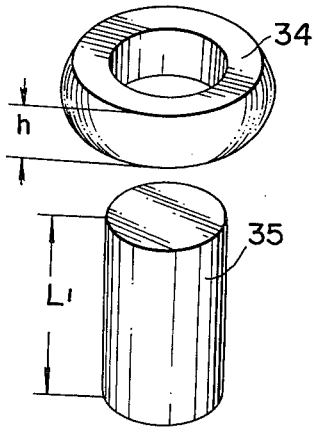

With the intermediate 31 held in the apparatus 40 in the state of FIG. 3(B), a shearing operation as the second step of this method is commenced at point Q in FIG. 5 by forcing the upper punch 54 to descend and simultaneously moving the lower punch 44 downwards in compliance with the descent of the upper punch 54. The upper die 52 is not moved at this stage. The simultaneous movement of the upper and lower punches 54 and 44 is continued until the lower end 59 of the upper punch 54 enters the hole 43 in the lower die 42 and reaches somewhat below the level of the upper end face 45 of the lower die 42 as shown in FIG. 3(C). In FIG. 5, point C corresponds to FIG. 3(C). During such movement of the two punches 54 and 44, the head portion 33 of the intermediate 31 is sheared along a cylindrical plane between the radially central region having the same diameter as the punch 54 and the annular peripheral region by the effect of the aforementioned cutting edges 47 and 57. As the result, the intermediate 31 parts into a ring 34 and a solid cylinder 35 as shown in FIG. 4(C). As will be understood, the inner periphery of this ring 35 is a cylindrical surface but the outer periphery is a longitudinally round and radially outwardly convex surface. Of course the inner diameter of the ring 35 corresponds to the diameter of the upper punch 54, and the thickness of the ring 35 is the same as the aforementioned thickness h of the head portion 33 of the intermediate 31. The solid cylinder 35 has the same diameter as the blank 30 in FIG. 4(A) and a length $L_1$ shorter than the initial length $L_0$ of the blank 30. The difference between the two lengths $L_0$ and $L_1$ is determined by the volume of the ring 34. To obtain the ring 35 with good smoothness of the cylindrical inner surface, it is effective to exert a counter-load of a suitable magnitude on the intermediate 31 via the descending lower punch 42 during the above described shearing process.

Figure 3D:
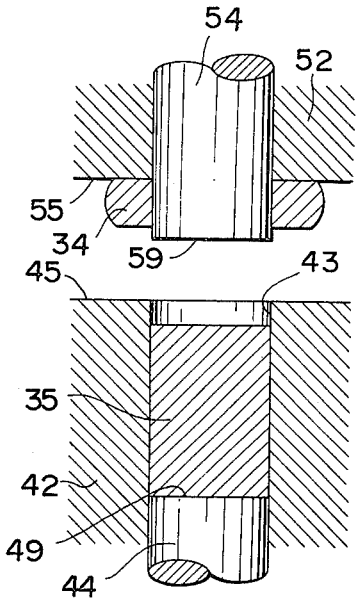
Figure 3E:
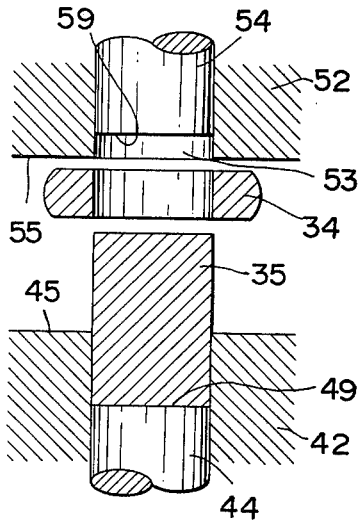

After completion of the shearing, the upper die 52 and the upper punch 54 are moved upwards, starting at point R in FIG. 5. Then the ring 35 parts from the lower die 42 to move upwards together with the upper die 52 and the upper punch 54, as shown in FIG. 3(D), since the ring 35 tightly fits around the punch 54. To detach the ring 35 from the upper punch 52, the punch 54 is pulled up at a higher rate than the upper die 52 as can be seen in FIG. 5. At point E in FIG. 5 where the ascent of the upper punch 54 is terminated, the lower end 59 of the punch 54 reaches the initial level of the same end face 59 in FIG. 3(A), but the lower end face 55 of the upper die 52 is yet at a slightly lower level, meaning that the lower end 59 of the punch 54 is in the hole 53 of the upper die 52 as shown in FIG. 3(E). Therefore, the ring 34 parts from the upper punch 54 before arrival of the punch 54 at the level of point E. After a short while, the upper die 52 reaches point F in FIG. 5 where the lower end face 55 of the die 52 becomes flush with the lower end 59 of the upper punch 54. Alternatively, the detachment of the ring 34 may be accomplished by pulling up the upper die 52 and the upper punch 54 at the same rate from the point R in FIG. 5 to the point E, or F, and thereafter further pulling up the upper punch 54 alone until its lower end 59 enters the hole 53 in the upper die 52.

Figure 3F:
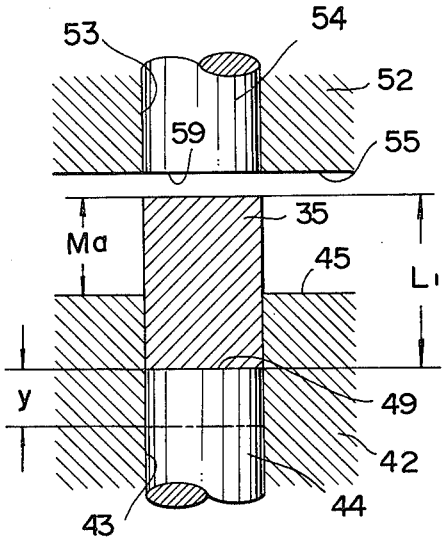

During the ascent of the upper die 52 and the upper punch 54, the lower punch 44 is moved upwards to thrust up the solid cylinder 35 remaining in the hole 43 of the lower die 42 and to result in that the upper end 49 of the lower punch 44 ascends from the level of point S in FIG. 5 to the level of point T where the upper end face of the solid cylinder 35 is above and at the distance $M_a$ described referring to FIG. 3(A) from the upper end face 45 of the lower die 42 as shown in FIG. 3(F). In this state, the upper end 49 of the lower punch 44 is at a level above its initial level (in FIG. 3(F) indicated by phantom line) in the state of FIG. 3(A) by a distance y that is determined by the volume of the ring 35. It will be apparent that the length $L_1$ of the cylindrical material 35 at this stage is given by $L_0$-y.

Thus, the first cycle of the operation is completed with the result that an end portion of the initial blank 30 is transformed into the ring 34 as the first product of this method.

Figure 3G:
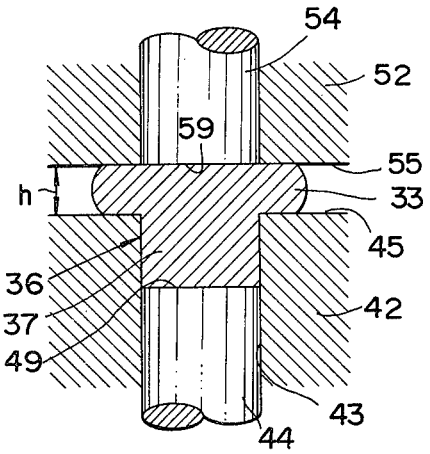
Figure 4D:
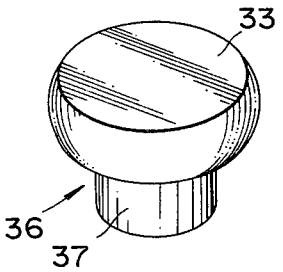

Successively, the second cycle of the operation is commenced to produce another ring by utilizing the solid cylinder 35 retained in the apparatus in the state of FIG. 3(F) as the blank material. The simultaneous descent of the upper die 52 and the upper punch 54 starts at point A' in FIG. 5. The upper punch 54 comes into contact with the blank 35 at point P', and thereafter the protruded end portion of the blank 35 undergoes free upsetting until the descent of the upper die 52 and the punch 54 terminates at point B' where the distance between the upper and lower dies 52 and 42 reaches the predetermined value h as shown in FIG. 3(G). By this upsetting working the cylindrical blank 35 is transformed into an intermediate 36 shown in FIG. 4(D). This intermediate 36 is identical with the intermediate 31 in the first cycle except that the cylindrical stem portion 37 of this intermediate 36 is shorter than the counterpart of the previous intermediate 31.

Figure 3H:
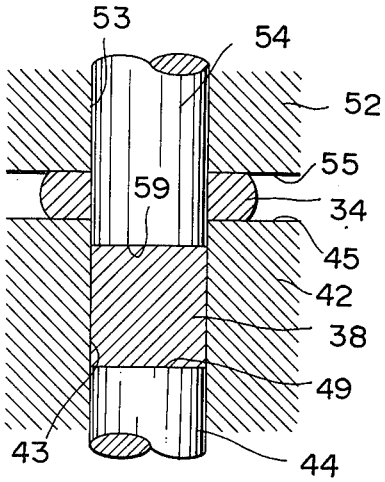
Figure 4E:
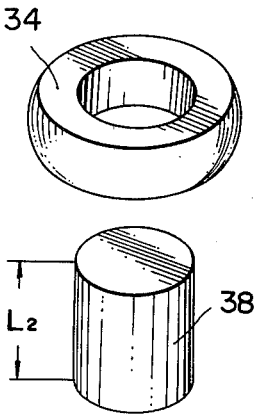

Then the shearing step is started at point Q' by forcing the upper punch 54 to descend and simultaneously moving the lower punch downwards and is completed at point C' where the lower end 59 of the upper punch 54 is somewhat below the level of the upper end face 45 of the lower die 42 as shown in FIG. 3(H). As the result, the intermediate 37 is divided into a ring 34 and a solid cylinder 38 as shown in FIG. 4(E). This ring 34 is identical with the ring 34 in FIG. 4(C) and, hence, is the product of the second cycle of the operation. The solid cylinder 38 has a length $L_2$ which is smaller than $L_1$ in FIG. 4(C) by the aforementioned value y.

Figure 3I:
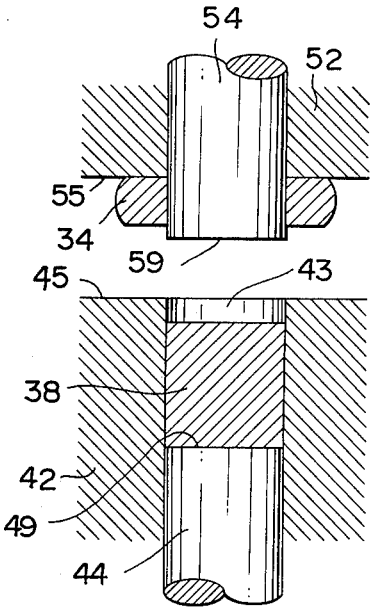
Figure 3J:
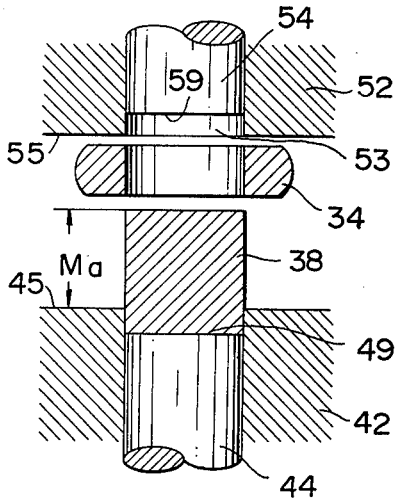

Thereafter the ring 34 is detached from the upper punch 54 by moving the upper die 52 from point R' in FIG. 5 to point F' and the upper punch 54 from point R' to point E' as illustrated by FIGS. 3(H) to 3(J). The lower punch 44 is moved upwards from point S' to point T' to thrust up the solid cylinder 38 remaining in the hole 43 so that the upper end face of the cylinder 38 reaches a level above and at the predetermined distance $M_a$ from the upper face 45 of the lower die 42. In this state, the upper end 49 of the lower punch 44 is at a level above its level in the state of FIG. 3(F) by the aforementioned distance y.

A next cycle of the operation to produce another ring can be started at point A" in FIG. 5 by utilizing the solid cylinder 38 retained in the apparatus 40 in the state of FIG. 3(J) as the blank material.

Next, another embodiment of the invention will be described with reference to FIGS. 6(A) to 6(G) and 7(A) to 7(C). This embodiment is a partial modification of the method and apparatus illustrate by FIGS. 3(A) to 3(J) and 4(A) to 4(E) to perform initial deformation of the blank in the manner of restricted upsetting.

Figure 6A:
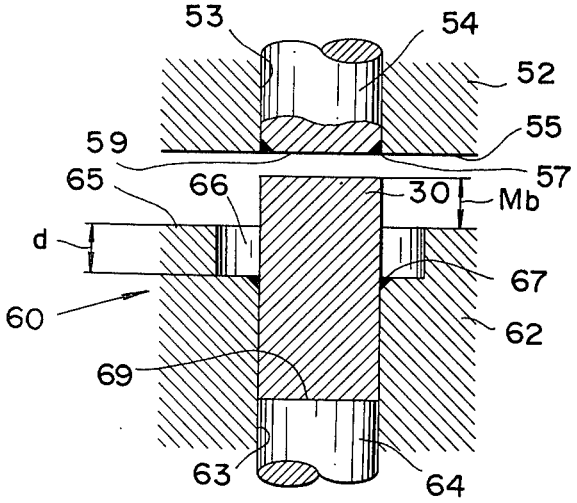
FIG. 6(A) is a fragmentary and partly longitudinal-sectional view of a set of dies and punches used in a ring producing method as another embodiment of the invention.

FIG. 6(A) shows apparatus 60 for use in this method. The principal part of this apparatus 60 consists of a lower die 62 which is fixed to the base of a conventional press (not shown) that serves as a forging machine, a lower punch 64 slidably fitted in a vertical and cylindrical hole 63 of the lower die 62 and supported by a lower sub-ram of the press, an upper die 52 which is attached to a main ram of the press and has a cylindrical through-hole 53 in axial alignment with the hole 63 in the lower die 62, and an upper punch 54 slidably fitted in the hole 53 and supported by an upper sub-ram of the press. The upper die 52 and the upper punch 54 can be taken as identical with the counterparts in the apparatus 40 of FIG. 4(A). The two holes 63 and 53 have the same diameter that corresponds to the inner diameter of the rings to be produced. The lower die 62 has an upper end face 65 which is flat and parallel to the lower end face 55 of the upper die 52, but a cylindrical recess 66 is formed in this end face 65 concentrically with the through-hole 63. This recess 66 has an outer diameter corresponding to the outer diameter of the rings to be produced, and the depth d of this recess 66 is made equal to the thickness of the rings. Indicated at 57 is a circumferential cutting edge.

The cylindrical blank 30 of FIG. 4(A) is used also in this method. Initially, the upper die 52 is sufficiently spaced from the lower die 62 with the lower end 59 of the upper punch 54 kept flush with the lower end face 55 of the upper die 52. The lower punch 64 is kept at a sufficiently low position, and the cylindrical blank 30 is fitted into the hole 63 of the lower die 62 so as to rest on the upper end 69 of the punch 64 and partly protrude from the upper end face 65 of the lower die 62 toward the upper die 52. Since the blank 30 occupies a central region of the circular recess 66, the remaining region of this recess 66 becomes an annular space. The length $M_b$ of the protruded end portion of the blank 30 is determined such that the volume of the protruded portion is equal to the volume of each ring to be produced.

The apparatus 60 of FIG. 6(A) is operated such that the lower end face 55 of the upper die 52, the lower end 59 of the upper punch 54 and the upper end 69 of the lower punch 64 change their respective positions in the manner as shown by the already described diagram of FIG. 5. The point A of FIG. 5 corresponds to the initial state shown in FIG. 6(A).

Figure 6B:
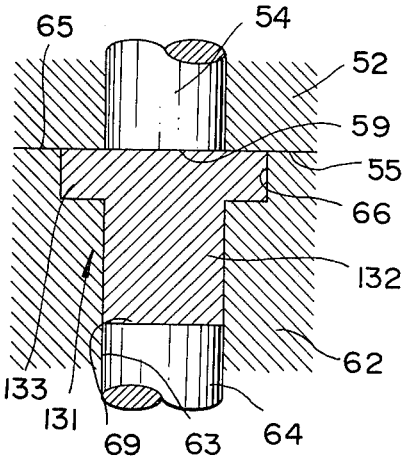
FIGS. 6(B) to 6(G) show the same set of dies and punches at different stages of the same method.
Figure 7A:
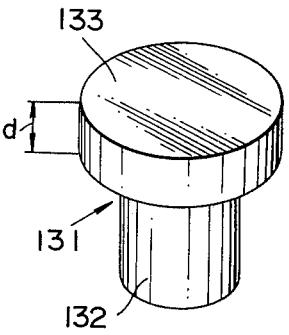
FIGS. 7(A) to 7(C) illustrate the manner of transformation of a cylindrical blank in the method illustrated by FIGS. 6(A) to 6(G)

An upsetting operation as the first step of this method is carried out by moving the upper die 52 together with the upper punch 54. At point P in FIG. 5 the upper punch 54 comes into contact with the blank 30, and at point B the lower end face 55 of the upper die 52 comes into contact with the upper end face 65 of the lower die 52. During descent of the upper die 52 and the punch 54 from the point P to the point B, the end portion of the blank 30 protruding through the recess 66 of the lower die 62 undergoes upsetting while radial expansion of the blank material is restricted by the cylindrical wall defining the outer periphery of the recess 66. At the end of this operation, the aforementioned annular space provided by the recess 66 is completely filled with the blank material as shown in FIG. 6(B), so that the blank 30 is transformed into an intermediate 131 shown in FIG. 7(A). This intermediate consists of a cylindrical stem portion 132 and a disk-shaped head portion 133 having a diameter corresponding to the outer diameter of the ring to be produced. Of course the thickness of the head portion 133 is equal to the depth d of the recess 66 in the lower die 62. As can be seen, this intermediate 131 is almost similar to the intermediate 31 of FIG. 4(B) except that the head portion 133 of this intermediate 131 has an exactly cylindrical side surface.

Figure 6C:
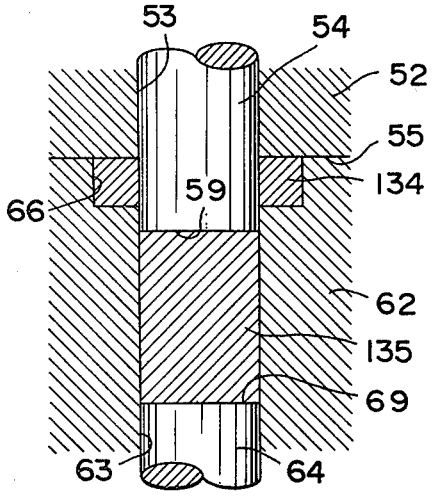
Figure 7B:
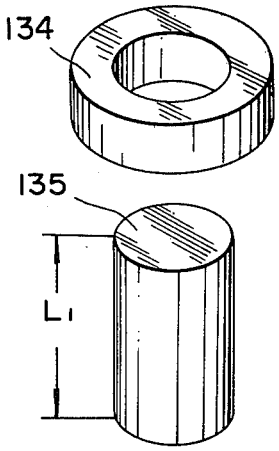

Then, a shearing operation as the second step of this method is carried out in the same manner as the shearing operation in the previously described embodiment to result in that the intermediate 131 parts into a ring 134 and a solid cylinder 135 as shown in FIGS. 6(C) and 7(B). Both the inner periphery and outer periphery of this ring 134 are cylindrical surfaces. The solid cylinder 135 has the same diameter as the blank 30 and a length $L_1$ shorter than the initial length $L_0$ of the blank 30 by the value y shown in FIG. 5. To obtain the ring 134 with good smoothness of its inner surface, it is effective to exert a counter-load of a suitable magnitude on the intermediate 131 via the descending lower punch 64 during the shearing operation.

Figure 6D:
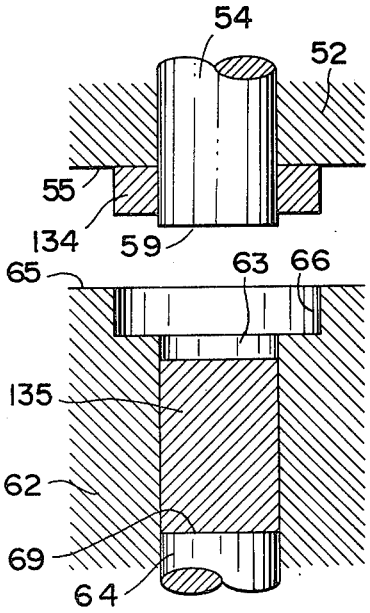
Figure 6E:
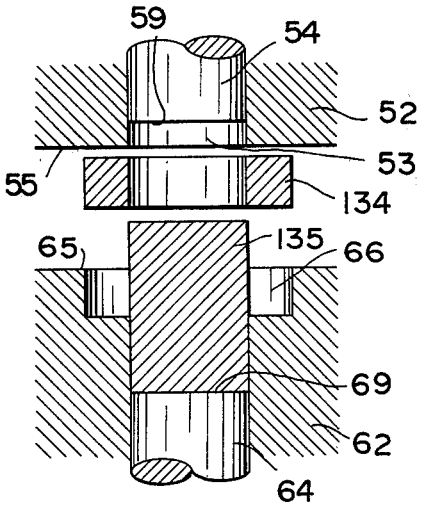

Thereafter, the ring 134 as the first product of this method is detached from the upper punch 54 by the same procedure as in the previously described embodiment, as illustrated by FIGS. 6(D) and 6(E). At the end of the first cycle operation, the apparatus 60 is adjusted so as to assume the state shown in FIG. 6(F) wherein the upper end 69 of the lower punch 64 is at a level above its initial level (indicated by phantom line) by the distance y, which is determined by the volume of the ring 134 and is equal to the difference between the initial length $L_0$ of the blank 30 and the length $L_1$ of the solid cylinder 135 at this stage.

Figure 6F:
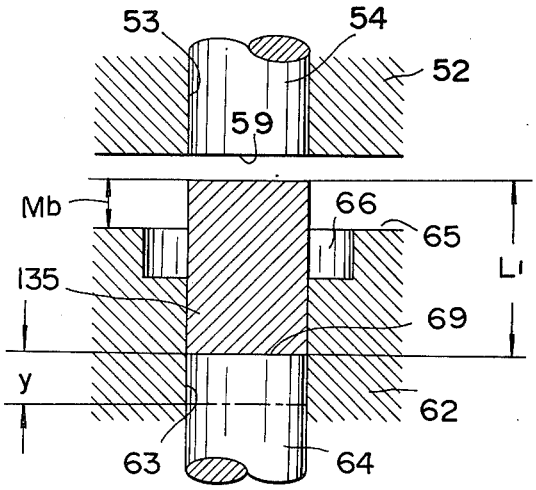
Figure 6G:
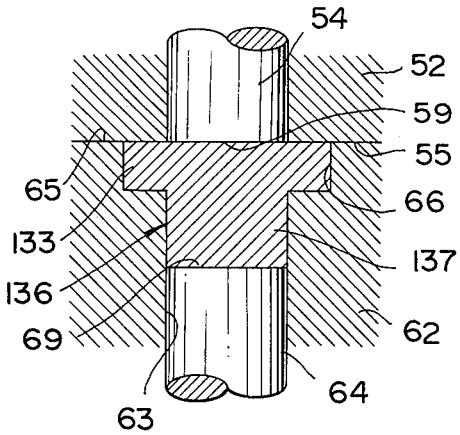
Figure 7C:
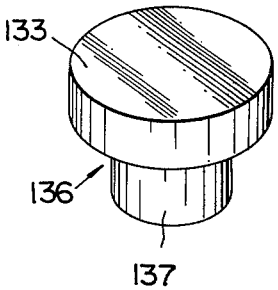

Successively, the second cycle of the operation is performed to produce another ring by utilizing the solid cylinder 135 retained in the apparatus 60 in the state of FIG. 6(F) as the blank material. The simultaneous descent of the upper die 52 and the upper punch 54 from the point A' to the point B' in FIG. 5 results in the transformation of the cylinder 135 into an intermediate 136 shown in FIGS. 6(G) and 7(C). This intermediate 136 is identical with the intermediate 131 in the first cycle except that the cylindrical stem portion 137 of this intermediate 136 is shorter than the counterpart of the previous intermediate 131. The subsequent shearing operation and detachment of the produced ring from the upper punch are performed in the same way as in the first cycle.

The rings 134 produced by this method are exactly as designed in their shape and excellent in their dimensional accuracy.

FIGS. 8(A) to 8(G), 9(A) to 9(C) and 10 illustrate another embodiment of the invention. In this method, an end portion of the blank is first deformed to a limited extent by free upsetting and then further deformed into a desired shape by closed die forging.

Figure 8A:
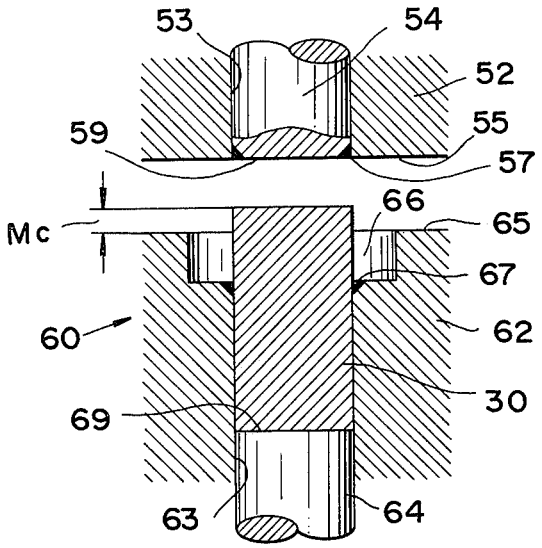
FIG. 8(A) is a fragmentary and partly longitudinal-sectional view of a set of dies and punches used in a ring producing method as a still different embodiment of the invention.

As can be seen in FIG. 8(A), apparatus 60 to perform this method is identical with the apparatus for the method illustrated by FIGS. 6(A) to 6(G), and the cylindrical blank 30 of FIG. 4(A) is used also in this method. Initially, the blank 30 is fitted into the central hole 63 of the lower die 62 so as to rest on the upper end 69 of the sufficiently lowered lower punch 64 and to partly protrude from the upper end face 65 of the lower die 62 toward the upper die 52. In this case the length $M_c$ of the protruded portion of the blank 30 is shorter than the length $M_b$ in the case of FIG. 6(A). The lower end 59 of the upper punch 54 is kept flush with the lower end face 55 of the upper die 52.

Figure 10:
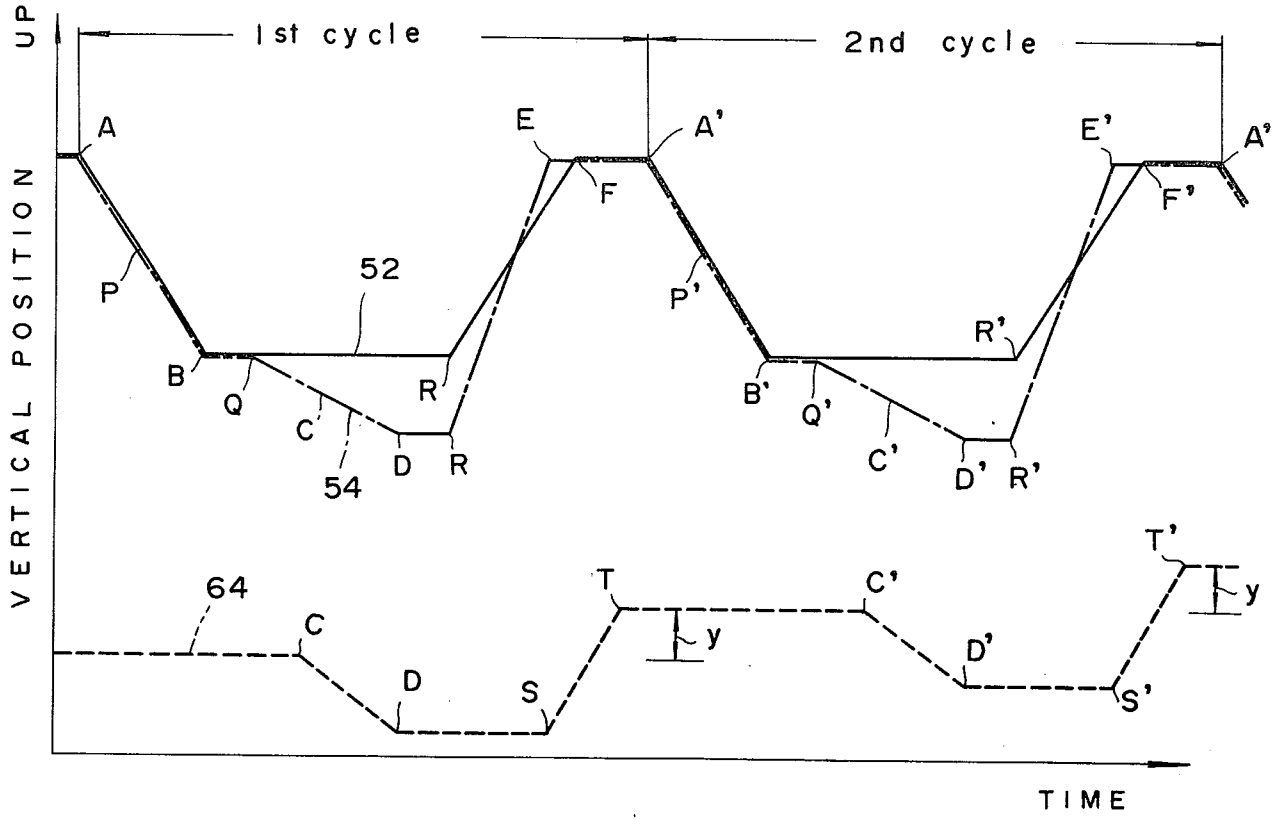
FIG. 10 is a diagram showing the sequence and extent of the movements of the punches and upper die of FIG. 8(A) in the method illustrated by FIGS. 8(A) to 8(G)

In this method, the apparatus 60 is operated such that the lower end face 55 of the upper die 52, the lower end 59 of the upper punch 54 and the upper end 69 of the lower punch 64 change their respective positions in the manner as shown in the diagram of FIG. 10. The point A in FIG. 10 corresponds to the initial state shown in FIG. 8(A).

Figure 8B:
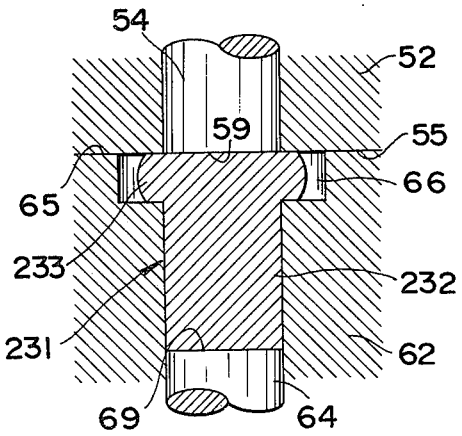
FIGS. 8(B) to 8(G) show the same set of dies and punches at different stages of the same method.
Figure 9A:
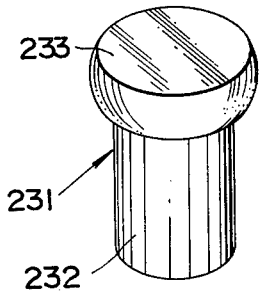
FIGS. 9(A) to 9(C) illustrate the manner of transformation of a cylindrical blank in the method illustrated by FIGS. 8(A) to 8(G)

The operation is started by moving the upper die 52 together with the upper punch 54. At point P in FIG. 10 the upper punch 54 comes into contact with the blank 30, and at point B the lower end face 55 of the upper die 52 comes into contact with the upper end face 65 of the lower die 62 as shown in FIG. 8(B). During the descent of the upper die 52 and the punch 54 from point P to point B, the end portion of the blank 30 protruding through the recess 66 of the lower die 62 undergoes free upsetting without arrival of the radially expanded portion at the cylindrical wall defining the outer periphery of the recess 66 because the length $M_c$ of the endmost portion protruding from the upper end face 65 of the lower die 62 is small relative to the diameter and depth of the recess 66 By this free upsetting process, the cylindrical blank 30 is transformed into a first intermediate 231 shown in FIGS. 8(B) and 9(A). This intermediate 231 consists of a cylindrical stem portion 232 and a head portion 233 larger in diameter than the stem portion 232. The thickness of the head portion 233 is equal to the depth of the recess 66 in the lower die 62, but the diameter of this head portion 233 is yet smaller than the diameter of the recess 66 corresponding to the outer diameter of the ring to be produced.

Figure 8C:
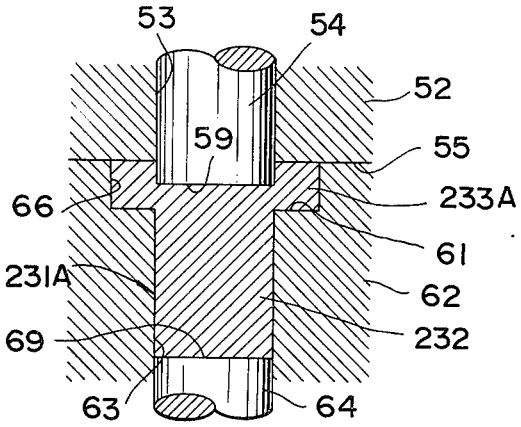
Figure 9B:
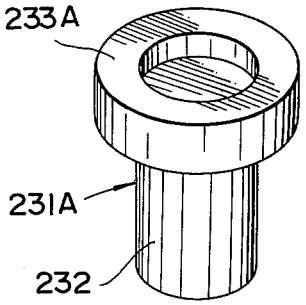

Thereafter, the upper punch 54 alone is moved further downward from point Q to point C in FIG. 10. By this movement of the upper die 54, the head portion 233 of the first intermediate 231 is compressed in its central region to reduce its thickness and is laterally expanded or extruded in its peripheral region within the closed annular space left in the recess 66 of the lower die 62 until complete filling of the annular space with the extruded blank material as shown in FIG. 8(C) corresponding to point C in FIG. 10. As the result, the first intermediate 231 is transformed into a second intermediate 231A shown in FIGS. 8(C) and 9(B). This intermediate 231A has the same stem portion 232 as the first intermediate 231 and a head portion 233A that consists of a central and relatively thin portion contiguous to the stem portion 232 and an annular brim portion. In other words, this head portion 233A has the shape of a disk formed with a cylindrical recess. As will be apparent from FIG. 8(C), the outer and inner diameters and the thickness of this annular brim portion are those of the ring to be produced.

Figure 8D:
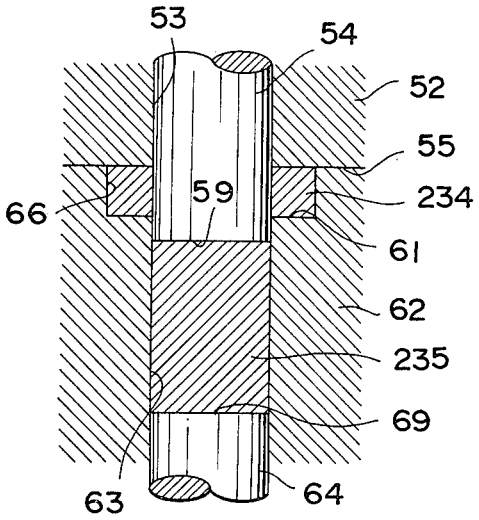
Figure 9C:
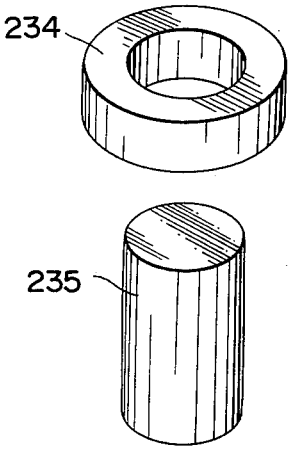

To consecutively perform shearing of the intermediate 231A in the state of FIG. 8(C), the upper punch 54 is further lowered from point C to point D in FIG. 10, and simultaneously the lower punch 64 is moved downwards in compliance with the descent of the upper punch 54. The state of the apparatus 60 at point D is shown in FIG. 8(D) wherein the lower end 59 of the upper punch 54 is somewhat below the bottom 61 of the recess 66 in the lower die 62. As the result, the second intermediate 231A parts into a ring 234 and a solid cylinder 235 as shown in FIGS. 8(D) and 9(C). It will be understood that this ring 234 and this cylinder 235 are identical with the ring 134 and the cylinder 135 in FIG. 7(B), respectively.

Figure 8E:
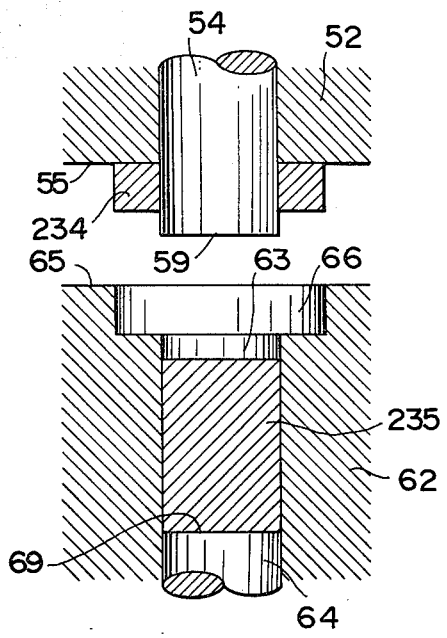
Figure 8F:
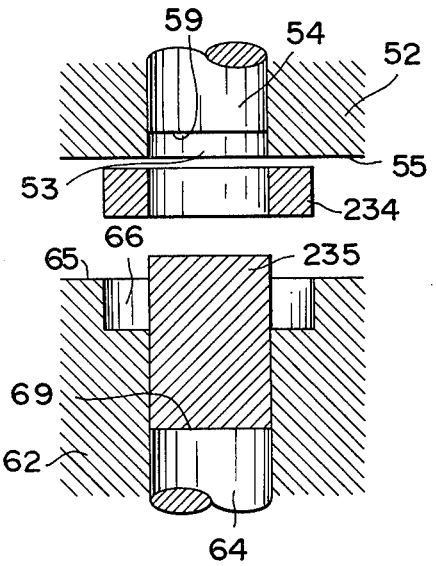

Thereafter, the ring 234 as the first product of this method is detached from the upper punch 54 by the same procedure as in the previously described embodiments, as illustrated by FIGS. 8(E) and 8(F). At the end of the first cycle operation, the apparatus 60 is adjusted to assume the state shown in FIG. 8(G), wherein the upper end 69 of the lower punch 64 is at a level above its initial level (indicated by phantom line) by the aforementioned distance y.

Figure 8G:
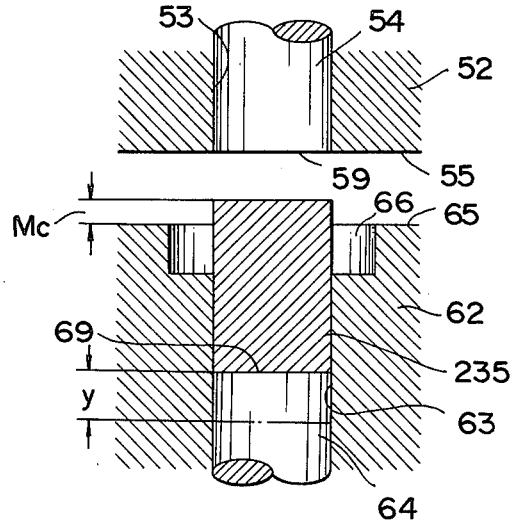

Successively, the second cycle of the operation is performed to produce another ring by utilizing the solid cylinder 235 retained in the apparatus 60 in the state of FIG. 8(G) as the blank material.

This method has the same merit as the method illustrated by FIGS. 6(A) to 6(G). Besides, it is possible to control the extent of filling of the annular space in the recess 66 with the expanded material by varying the timing of the point C in FIG. 10 to thereby prevent either insufficient filling that will result in inaccuracy in the shape of the produced ring or excessive filling that will damage the apparatus.

Figure 11:
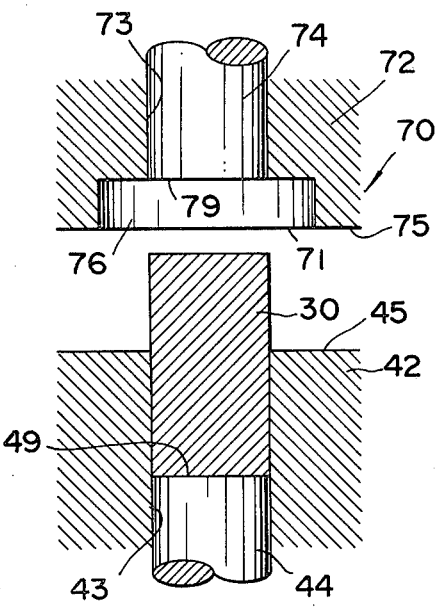
FIGS. 11, 12 and 13 respectively show three still different sets of dies and punches which are also for use in ring producing methods according to the invention.

FIG. 11 shows apparatus 70 as an alternative to the apparatus 60 of FIGS. 6(A) and 8(A) to perform either the method illustrated by FIGS. 6(A) to 6(G) or the method illustrated by FIGS. 8(A) to 8(G). The lower die 42 and lower punch 44 of this apparatus are identical with the counterparts in the apparatus 40 of FIG. 3(A). A vertically movable upper die 72 of this apparatus 70 has a lower end face 75 flat and parallel to the upper end face 45 of the lower die 42 and is formed with a vertical through-hole 73 in axial alignment with the hole 43 in the lower die 42. The two holes 43 and 73 have the same diameter. A cylindrical recess 76 is formed in the lower end face 75 of the upper die 72 concentrically with the through-hole 73. This recess 76 has a diameter corresponding to the outer diameter of the rings to be produced, and the depth of this recess 76 is made equal to the thickness of the rings. An upper punch 74 having a flat end 79 is slidably fitted in the central hole 73 of the upper die 72. As will readily be understood, the recess 76 in this apparatus 70 serves the same purpose as the recess 66 in the lower die 62 of the apparatus 60 of FIG. 6(A). In operation, the cylindrical blank 30 is held in the lower die 42, and the upsetting process is started by moving the upper die 72 downwards together with the upper punch 74 held such that the lower end 79 of the punch 74 is flush with the bottom 71 of the recess 76.

Figure 12:
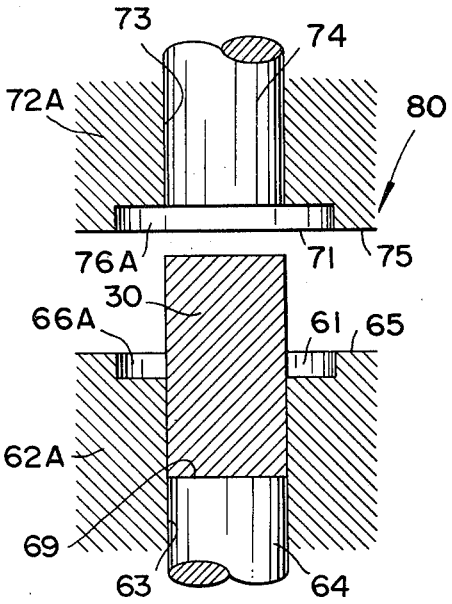

FIG. 12 shows apparatus 80 as a modification of the apparatus 70 of FIG. 11. In principle, this apparatus 80 is a combination of the lower die 62 and lower punch 64 of FIG. 6(A) and the upper die 72 and upper punch 74 of FIG. 11. That is, lower die 62A of this apparatus 80 is formed with a cylindrical recess 66A concentrically with the through-hole 63, and upper die 72A is formed with a cylindrical recess 76A concentrically with the through-hole 73. The two recesses 66A and 76A have the same diameter corresponding to the outer diameter of the rings to be produced, but each of these recesses 66A, 76A has a depth smaller than the thickness of the rings such that, when the upper die 72A is in close contact with the lower die 62A, the distance between the bottom 61 of the lower recess 66A and the bottom 71 of the upper recess 76A agrees with the thickness of the rings. The blank 30 is held in the lower die 72A, and the upsetting process is started by lowering the upper die 72A and the upper punch 74 with the lower end 79 of the punch 74 kept flush with the bottom 71 of the recess 76A of the upper die 72A. Both the method illustrated by FIGS. 6(A) to 6(G) and the method illustrated by FIG. 8(A) to 8(G) can be performed by using this apparatus 80.

Figure 13:
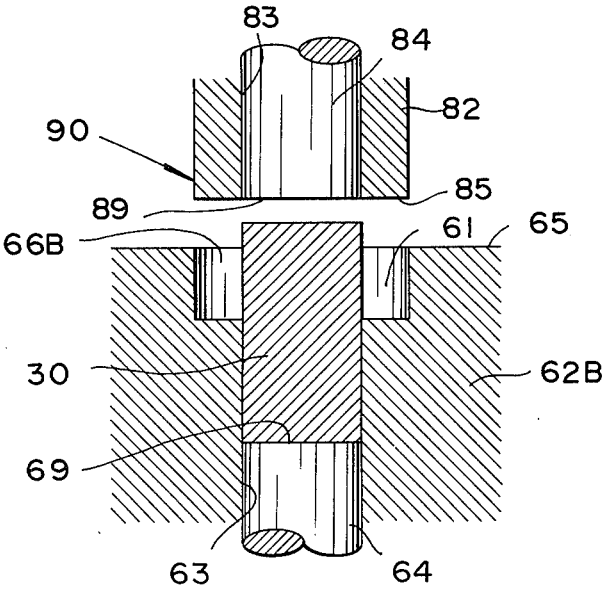

FIG. 13 shows a still differently designed apparatus 90 to perform a method according to the invention. A lower die 62B and lower punch 64 of this apparatus are almost identical with the counterparts in the apparatus 60 of FIG. 6(A). However, a cylindrical recess 66B formed in the upper end face 65 of the lower die 62B concentrically with the through-hole 63 has a depth greater than the thickness of the rings to be produced. The diameter of this recess 66B corresponds to the outer diameter of the rings. A vertically movable upper die 82 of this apparatus has a cylindrical shape in its lower end portion so as to slidably fit into the recess 66B in the lower die 62B. This upper die 82 is formed with a vertical through-hole 83 in axial alignment with the through-hole 63 in the lower die 62B, and an upper punch 84 having a flat lower end 89 is slidably fitted in this through-hole 83. The two holes 63 and 83 have the same diameter corresponding to the inner diameter of the rings.

In the through-hole 63 of the lower die 62B the cylindrical blank 30 rests on the upper end 69 of the lower punch 64, which is positioned such that an end portion of the blank 30 protrudes into the recess 66B. The upper end face of the blank 30 may reach a level above the upper end face 65 of the lower die 62B, though not necessarily. Upsetting of this end portion of the blank 30 is accomplished by moving the upper die 82 downwards, together with the upper punch 84 with its lower end 89 kept flush with the lower end face 85 of the die 82, to intrude into the recess 66B in the lower die 62B until the distance of the lower end face 85 of the upper die 82 from the bottom 61 of the recess 66B reaches a predetermined value corresponding to the thickness of the rings to be produced. This apparatus 90 can be used to perform either the method illustrated by FIGS. 6(A) to 6(G) or the method illustrated by FIGS. 8(A) to 8(G), but this apparatus 90 offers its advantage particularly when used in the former method because neither insufficient nor excessive filling of the annular space given in the recess 66B with the laterally expanded blank material can be achieved simply by adjusting the stroke of the upper die 82 in the upsetting operation.

It will be understood that any one of the above described embodments of the invention can be modified by using the upper die as a stationary die and the lower die as a vertically movable die with no difference in the principle of the ring producing process and the result. Also it is possible to move both the upper and lower dies. Besides, the vertical arrangement of the upper and lower dies can be reversed so that the blank is fitted in the through-hole of the upper one of the two dies. As a different modification, the vertically opposing arrangement of the two dies and two punches in any embodiment can be changed to a horizontally opposing arrangement so that the cylindrical blank is held horizontally and worked by using one of the two dies as a horizontally movable die, or by using the both dies as movable dies.

It is also possible to perform the upsetting step and the succeeding shearing step in a method of the invention by moving only the punches while keeping the both dies in fixed positions. For example, FIGS. 14(A) to 14(C) illustrate the operation of the apparatus of FIG. 11 in such manner.

Figure 14A:
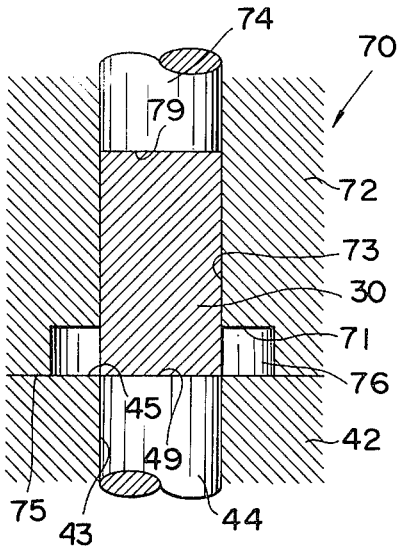
FIGS. 14(A) to 14(C) show a set of dies and punches of the type as shown in FIG. 11 at three different stages of a ring producing method as a still different embodiment of the invention.
Figure 14B:
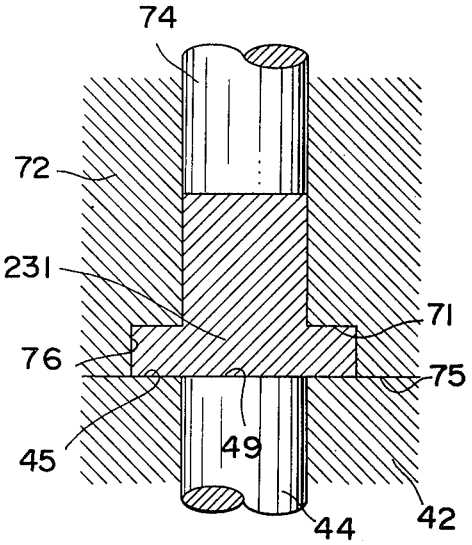
Figure 14C:
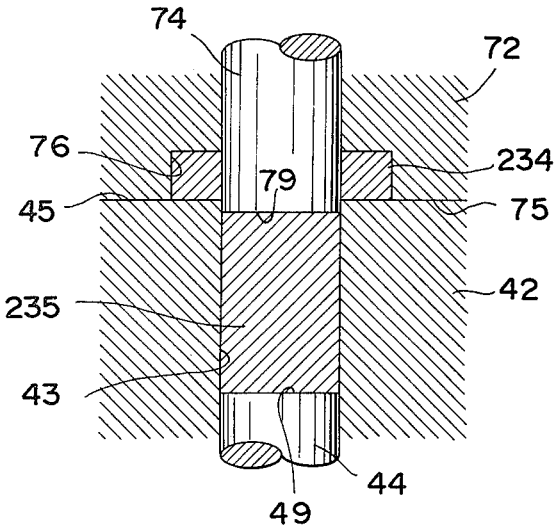

As shown in FIG. 14(A), the upper die 72 is pressed against the lower die 42 so that the flat end faces 45 and 75 of the two dies 42 and 72 are kept in close contact with each other. The lower punch 44 is positioned such that the upper end 49 of the punch 44 is flush with the die face 45, and the cylindrical blank 30 is inserted into the through-hole 73 in the upper die 72 to rest on the upper end 49 of the lower punch 44. Accordingly a radially outer portion of the recess 76 of the upper die 72 becomes a closed and annular space surrounding the lower end portion of the blank 30. In this state, the upper punch 74 is moved downwards to compress the blank 30 against the lower punch 44 to thereby upset an end portion of the blank 30 until complete filling of the annular space with the laterally expanded blank material, as shown in FIG. 4(B). As the result, the blank 30 transforms into an intermediate 231 which is similar in shape to the intermediate 131 of FIG. 7(A).

The shearing step is performed consecutively by forcing the upper punch 74 to further descend and simultaneously moving the lower punch 44 downwards in compliance with the descent of the upper punch 74. Referring to FIG. 14(C), the descent of the two punches 74 and 44 is continued until the lower end 79 of the upper punch 74 reaches a level slightly below the upper end face 45 of the lower die 42, though the shearing of the intermediate 231 in FIG. 14(B) to divide it into a ring 234 and a solid cylinder 235 as shown in FIG. 14(C) does not need such a long descending stroke of the punches 74 and 44, so that the solid cylinder 235 is entirely received in the hole 43 in the lower die 42. After that, the upper die 72 is parted from the lower die 42 and the upper punch 74 is pulled up to take out the produced ring 234.

Figure 15:
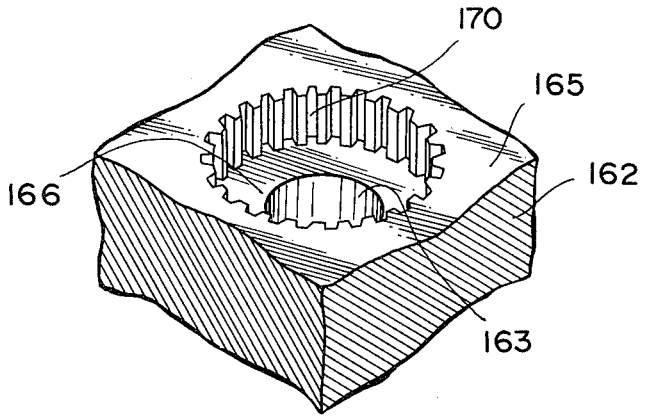
FIG. 15 is a fragmentary and perspective view of a die for use in a ring producing method according to the invention to produce a ring having gear teeth.

FIG. 15 shows a metal die 162 to be used as the lower die 62 in either the apparatus 60 of FIG. 6(A) or the apparatus 90 of FIG. 13 when it is intended to produce a ring-shaped metal part having gear teeth on its outer periphery by a method according to the invention. The die 162 has a flat surface 165 as its upper end face and a vertical and cylindrical through-hole 163. In the upper end face 165, a cylindrical recess 166 is formed concentrically with the hole 163, and internal gear teeth 170 are cut in the cylindrical surface defining the outer periphery of the recess 166. By performing the closed space upsetting operation illustrated by FIGS. 6(A) and 6(B) or FIGS. 8(A) to 8(C), or more preferably by using the apparatus 90 of FIG. 13, it is possible to obtain an intermediate which is fundamentally similar to the intermediate 131 of FIG. 7(A) but is formed with external gear teeth corresponding to the gear teeth 170 of the die 162 on the cylindrical surface of the head portion. Therefore, a ring-shaped metal part having the external gear is obtained by consecutively performing the already described shearing operation without any modification.

Figure 16:
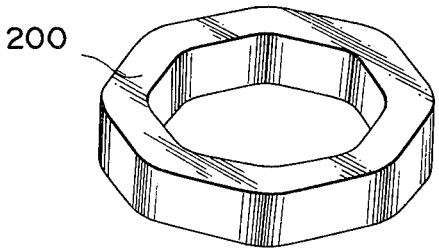
FIG. 16 is a perspective view of a ring-like metal part having a roughly octagonal shape as an example of variously shaped ring-like metal parts producible by a method according to the invention.

In the above described embodiments of the invention, the apparatus and the blank are so designed as to produce ring-shaped metal parts which are circular in their outer and inner peripheries. However, it is also possible to produce ring-like metal parts which are noncircular in their outer and/or inner peripheries. For example, FIG. 16 shows a ring-like metal part 200 which is approximately octagonal in its outer and inner peripheries. This metal part 200 can be produced by the method illustrated by FIGS. 6(A) to 6(G), for example, by altering the cross-sectional shape of the blank, upper and lower punches and the through-holes in the upper and lower dies to an approximately octagonal shape corresponding to the inner periphery of the metal part 200 and the cross-sectional shape of the recess in the lower die to the approximately octagonal shape of the outer periphery of the metal part 200. Of course, ring-like metal parts having any other polygonal shape can be produced by similar modification. As will be understood, also it is possible to produce ring-like metal parts having elliptical peripheries by a method according to the invention.

What is claimed is:

1. A method of producing a plurality of identical ring-shaped or ring-like metal parts having inner and outer peripheries, comprising the steps of:

(a) applying a compression force to a blank of a metal material, which is in the shape of a solid rod having an outer periphery corresponding to the inner periphery of the metal parts to be produced, in a longitudinal direction of said blank so as to upset an end portion of said blank until said end portion transforms into a laterally expanded portion having a side periphery corresponding to the outer periphery of said metal parts and a length corresponding to the thickness of said metal parts, said applying step including the sub-steps of inserting said blank into a fitting through-hole formed in a first die which has a flat die face and is formed with a recess in said die face, said recess bieng coaxial with said through-hole and having a depth corresponding to the thickness of said metal parts and an outer periphery corresponding to the outer periphery of said metal parts, such that said end portion of said blank longitudinally protrudes into said recess and comes into contact with a flat die face of a second die which is arranged opposite to said first die and held stationary with said die face thereof in close contact with said die face of said first die such that the second die face, recess of the first die, punch and through-hole form a closed cavity, said first die being provided with a punch which is slidably fitted in said through-hole to come into contact with the other end of said blank, and moving said punch toward said second die to longitudinally compress said end portion of said blank within said closed cavity against said die face of said second die until a space provided by a peripheral region of said recess and defined between the bottom of said recess and said die face of said second die is completely filled with a laterally expanded portion of said end portion of said blank;

(b) subjecting said laterally expanded portion to shearing along a plane defining the outer periphery of said blank thereby parting said laterally expanded portion into a peripheral portion, which is one of said metal parts, and a central portion which remains as an end portion of the blank shortened by the step (a); and (c) repeating the steps (a) and (b) by using the shortened blank remaining after the step (b) in place of said blank in the initial step (a), wherein said second die is formed with a through-hole which is coaxial with and identical in cross-sectional shape with said through-hole in said first die and is provided with a plunger slideably fitted into said through-hole thereof, the step (a) being performed by keeping an end face of said plunger flush with said die face of said second die to serve as part of said die face of said second die so that the end face of said plunger and the die face of the second die present a substantially planar surface to the recess of the first die, the step (b) being performed by forcing said punch to move toward said second die while said first and second dies are kept in the state at the end of the step (a) thereby thrusting the blank except said laterally expanded portion and simultaneously moving said plunger in compliance with the movement of said punch until the end face of said punch which is in contact with said blank enters said through-hole in said second die.

2. A method of producing a plurality of identical ring-shaped or ring-like metal parts having inner and outer peripheries in an apparatus which includes:

A first die having a fitting guide through-hole formed therein, a flat die face having a recess which is coaxial with said guide through-hole, has a depth corresponding to the thickness of the metal parts to be produced, and has an outer periphery corresponding to the outer periphery of the metal parts to be produced;

a punch slidably fitted in the guide through-hole in said first die;

a second die having a substantially flat die face arranged opposite said first die; and means for maintaining said second die stationary relative to said first die with the die face thereof in close contact with said die face of said first die, the method comprising the procedural combination of steps of:

(a) inserting a blank of a metal, in the shape of a solid rod having an outer periphery corresponding to the inner periphery of the metal parts to be produced, into the fitting guide through-hole in said first die such that an end portion of said blank longitudinally protrudes into said recess and is in contact with the die face of the second die;

(b) maintaining said second die stationary relative to said first die with the die face thereof in close contact with said die face of said first die so that the second die face, recess of the first die, punch and guide through-hole form a closed cavity;

(c) applying a compression force to said blank within said closed cavity, by moving the punch toward the second die, in a longitudinal direction of said blank to upset said end portion of said blank for a time sufficient to transfer said end portion into a laterally expanded portion having a side periphery corresponding to the outer periphery of said metal parts and a length corresponding to the thickness of said metal parts by compressing the end portion of said blank against the die face of said second die until a space provided by a peripheral region of said recess and defined between the bottom of said recess and the die face of said second die is completely filled with a laterally expanded portion of said end portion of the blank;

(d) subjecting said laterally expanded portion to shearing along a plane defining the outer periphery of said blank thereby parting such expanded portion into a peripheral portion which is one of said metal parts and a central portion which remains as an end portion of the blank shortened by the aforesaid steps (b) and (c); and (e) repeating the steps of applying and subjecting using the shortened blank in the place of the original blank in the step (a), wherein said second die is formed with a through-hole which is coaxial with and identical in cross-sectional shape with said through-hole in said first die and is provided with a plunger slideably fitted into said through-hole thereof, the step (c) being performed by keeping an end face of said plunger flush with said die face of said second die to serve as part of said die face of said second die so that the second die face, recess of the first die, punch and guide through-hole form a closed cavity, the step (d) being performed by forcing said punch to move toward said second die while said first and second dies are kept in the state at the end of the step (c) thereby thrusting the blank except said laterally expanded portion and simultaneously moving said plunger in compliance with the movement of said punch until the end face of said punch which is in contact with said blank enters said through-hole in said second die.

3. A method according to either of claims 1 or 2, wherein a wall defining the outer periphery of said recess is formed with internal gear teeth, whereby each of said metal parts is formed with an external gear teeth corresponding to said internal gear teeth.

4. A methd according to either of claims 1 or 2, wherein said blank is cylindrical.

5. A method according to either of claims 1 or 2, wherein the cross-sectional shape of said blank is substantially polygonal.

6. A method according to either of claims 1 or 2, wherein the cross-sectional shape of said blank is elliptical.

7. A method according to either of claims 1 or 2, further comprising the step of preheating said blank prior to the step of applying a compressive force.

8. The method as set forth in either of claims 1 or 2, wherein the steps of upsetting and shearing are carried out while maintaining said blank in position by said guide through-hole and said punch without otherwise circumferentially clamping said blank.

* * * * *